United States Patent [19]

Lefebvre

[11] Patent Number: 4,472,136

[45] Date of Patent: Sep. 18, 1984

[54] FLAME RETENTION HEAD ASSEMBLY FOR FUEL BURNERS

[76] Inventor: Denis Lefebvre, 1235 Louise St., P.O. Box 711, Mascouche, Quebec, Canada, J0N 1C0

[21] Appl. No.: 538,269

[22] Filed: Oct. 3, 1983

[30] Foreign Application Priority Data

Oct. 13, 1982 [CA] Canada ..... 413362

[51] Int. Cl.[3] ..... F23C 5/06; F23Q 3/00

[52] U.S. Cl. ..... 431/186; 431/189; 431/265; 431/329; 431/354; 431/183; 239/403

[58] Field of Search ..... 431/186, 189, 183, 265, 431/329, 268, 354, 350, 351, 353, 347, 284, 285; 239/403, 404, 405; 126/116 R; 60/723

[56] References Cited

U.S. PATENT DOCUMENTS

| | | | |
|---|---|---|---|
| 1,698,258 | 1/1929 | Cook | 431/353 X |
| 3,477,824 | 11/1969 | Reed | 431/354 |
| 3,664,804 | 5/1972 | Flournoy et al. | 431/183 |
| 3,733,169 | 5/1973 | Lefebvre | 431/265 |
| 4,082,484 | 4/1978 | Lefebvre | 431/183 |

*Primary Examiner*—Randall L. Green

*Attorney, Agent, or Firm*—Robic, Robic & Associates

[57] ABSTRACT

Four-stage flame retention head assembly for use in the air pipe of a fuel burner having a fuel nozzle mounted coaxially within the air pipe. This assembly comprises an outwardly diverging flame retention head mounted in the air pipe in front of the fuel nozzle. This head successively defines, starting from its smaller end, an air-and-fuel mixture chamber; a first inwardly open expansion chamber; a throttle section and an outwardly convex section defining a second expansion chamber. A primary air inlet annular plate is mounted transversely at the inlet end of the head and has a central opening circumscribed by a continuous annulus. The latter has a series of air inlet apertures and loovers over the apertures, the latter and the loovers causing swirling of the air as it enters into the mixing chamber. The first and second expansion chambers are provided with circumferentially spaced air apertures to pass air into the retention head to sustain combustion therein as well as to cool the head.

13 Claims, 9 Drawing Figures

FLAME RETENTION HEAD ASSEMBLY FOR FUEL BURNERS

The present invention relates to a flame retention head assembly for a fuel burner of the gas or oil type, and to a fuel burner assembly including the said flame retention head assembly. The invention is particularly an improvement of the flame retention head assemblies and burners disclosed in my prior U.S. Pat. Nos. 3,733,169 of May 15, 1973 and 4,082,495 of April 4, 1978, respectively corresponding to my Canadian Pat. Nos. 937,152 of Nov. 20, 1973 and 1,085,710 of Sept. 16, 1980.

In the above type of burners, with which the present invention is concerned, it is desired to provide for the intimate mixture of air and fuel in such a way that combustion thereof is confined in the burner head rather than taking place in a separate combustion chamber of a furnace, for instance. This is achieved by the use of a flame retention head secured to the fuel burner assembly within the air supply pipe. Such a head makes it possible better to control and to sustain the combustion reaction.

While the flame retention heads of my prior patents have proved to be quite successful, I have found that appreciable improvement can be had in terms of a greater combustion efficiency and more adequate flame pattern control in a new head which has a main body diverging outwardly from the fuel nozzle discharge mouth and wherein air and fuel mixture and combustion are made to take place in four successive stages, each in one of four different chambers following one another between the smaller and larger ends of the flame retention head. Thus, air and fuel mixture takes place in a first cylindrical chamber, a first expansion and the ignition of the mixture occur in an inwardly open expansion chamber, the flame is thereafter compressed in a throttle chamber and is allowed again to expand in a second expansion chamber defined by an outwardly convex section and following immediately the throttle section. Adequate air to sustain combustion and cool the head is admitted into the two expansion chambers. I believe that the greater combustion efficiency as well as the more adequate flame pattern control are due to this flame compression stage disposed between the two expansion stages, which allows to convert static energy of air and gaseous fuels into kinetic energy thus favorizing a more homogeneous mixture.

More specifically, and in accordance with the broad concept of the invention, I have provided and I claim herein a four-stage flame retention head assembly for use in the air pipe of a fuel burner having a fuel nozzle mounted coaxially within the air tube, the assembly comprising: an outwardly diverging retention head adapted to be mounted within the air pipe concentrically thereof and in front of the fuel nozzle, the retention head comprising, successively: a substantially cylindrical inner section defining an air and fuel mixture chamber, radially outwardly directed wall means defining an inwardly open expansion chamber terminating into a throttle chamber, and an outwardly flaring convex section defining a second expansion chamber; a primary air inlet annular plate mounted transversely at the inlet end of the first cylindrical section, the transverse plate having a central opening circumscribed by a continuous annulus provided with a series of air inlet apertures and with loovers extending over the apertures outwardly of the annulus whereby to cause air to swirl as it enters the mixture chamber and mix therein with the fuel discharged from the nozzle, and wherein the outwardly flaring conical section and the outwardly convex section have circumferentially spaced air apertures therethrough to pass air into the retention head to sustain combustion therein and to cool the head.

Referring now to the drawings wherein preferred embodiments of the present invention are described in greater detail, FIG. 1 is a longitudinal cross-sectional view of a burner assembly, using gas as fuel, and incorporating the flame retention head assembly and other features of the present invention;

FIG. 2 is a cross-sectional view of the nozzle end of the burner assembly of FIG. 1, shown on a larger scale;

FIG. 2*a* is a cross-section, on an enlarged scale, of a portion of the burner assembly of FIG. 2;

Figure 1:
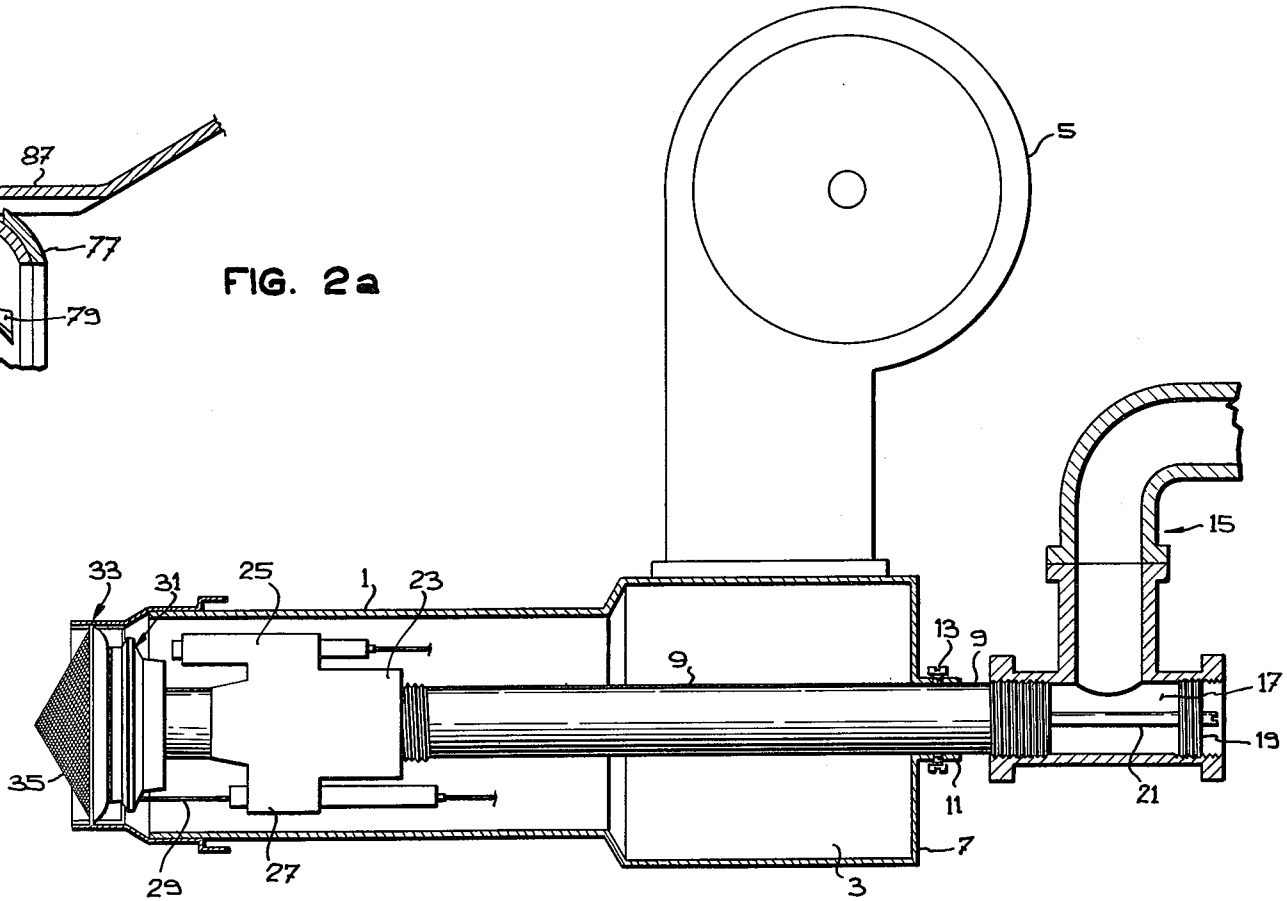

Referring now to FIGS. 1 through 4, there is shown a fuel burner installation where gas is used as a fuel. The installation, or burner assembly, comprises an air supply pipe 1 widening at one end to provide an air plenum chamber 3 connected to a blower 5 and closed, at that end, by a radial wall 7 apertured at the center to allow for the passage of a gas line 9 supported by a collar 11 solid with the radial wall 7, the gas line 9 being secured onto the collar 11 by screws 13 or any other suitable means. A gas supply connector 15 is screwed onto the end of the gas line 9 lying outside the plenum chamber 3 and defines an inlet chamber 17 closed by a disc 19 removably screwed into the chamber 17. Through this disc 19 extends a spinner plate adjusting rod 21 extending centrally of the gas line 9 and to which further reference will be made hereinbelow.

The other end of the gas line 9 is screwed into the body 23 of a gas nozzle assembly of conventional type having the usual flame detector 25, capable of shutting off the installation in the absence of any flame in the retention head, and an also conventional electric gas ignitor 27 of which the electrodes 29 enter into the retention head, as is explained further later.

The flame retention head 31, proper, is fixed to the gas nozzle, at one end, and held by a mounting support 33, at the other end. Also at that end, the head 31 is provided with a known combustion-promoting catalytic screen 35, secured thereto in any known manner. This screen may be made, as is known, of nickel oxide, platinum and/or palladium. It is used only on gas-fired burner assembly.

Figure 2A:
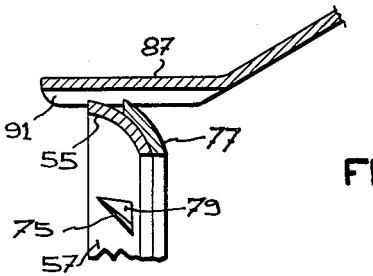
Figure 2:
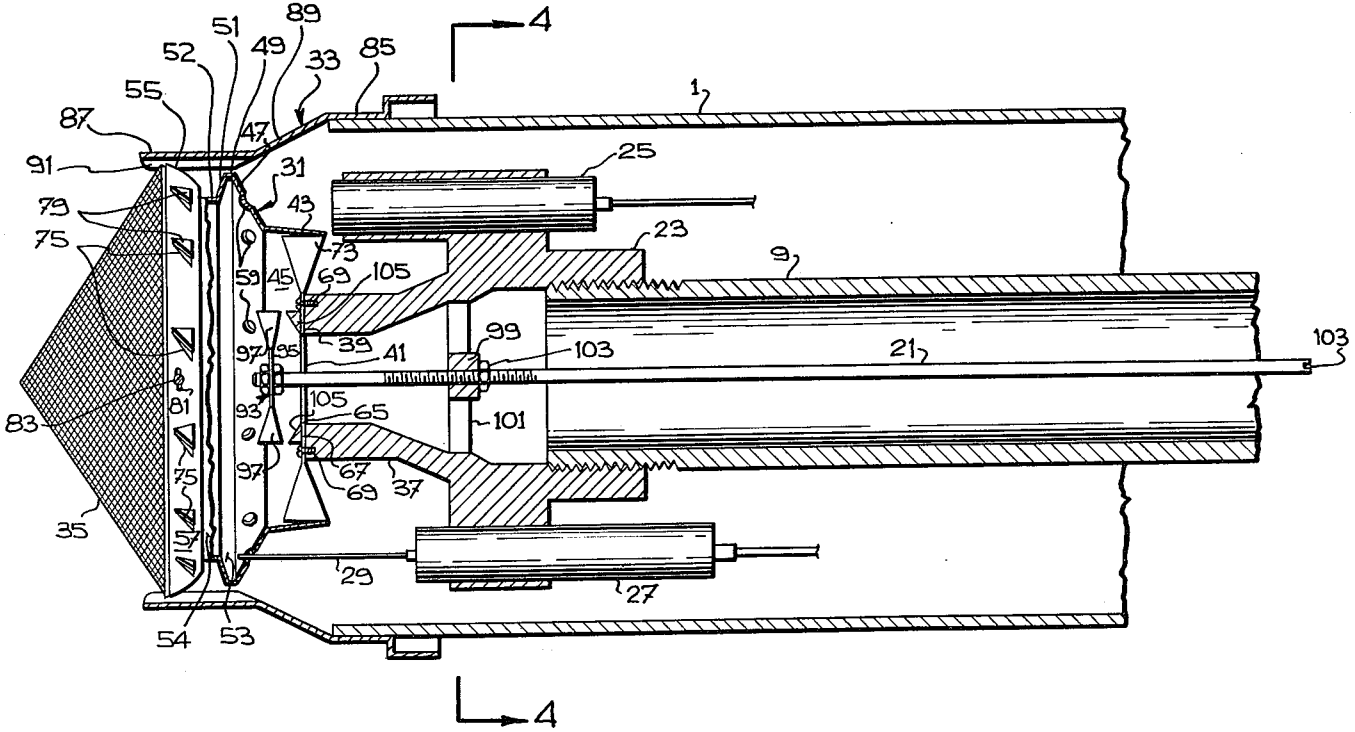
Figure 4:
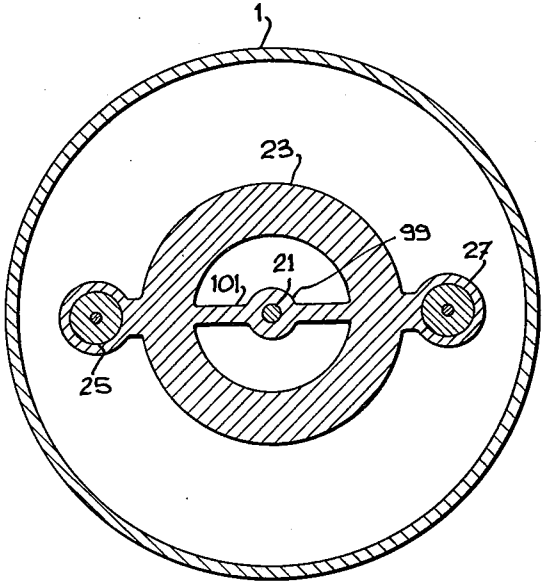
FIG. 4 is a cross-sectional view along line IV—IV of FIG. 2, rotated by 90°.

Referring now to FIG. 2, the nozzle body 23 terminates into a cylindrical nozzle 37 having an annular radial face 39 inwardly defining a gas discharge orifice or mouth 41. The four-stage flame retention head which is the main object of the present invention is secured to this annular face 39 and will now be described in detail.

As has been said previously, the head 31 is an outwardly diverging member disposed in front of the fuel nozzle 37 and made up of the following integrally connected parts: a substantially cylindrical first section 43, defining a chamber 45 for the mixture of fuel and air; an outwardly flaring frustoconical section 47 followed by a second cylindrical section 49, further followed by an inwardly flaring frusto-conical section 51, sections 47, 49 and 51 thus constituting wall means defining a first expansion chamber 53; a third cylindrical section 52 which defines a throttle chamber 54 and, finally, an outwardly convex section 55, preferably parabolic, which defines a second expansion chamber 57.

Thus, and as aforesaid, the head 31 defines two expansion chambers 53, 57 separated by a throttle chamber 54 to provide the improved combustion and flame pattern control.

As shown, conical section 47 and convex or parabolic section 55 are provided with circumferentially spaced air apertures 59 and 75 both of which are intended to sustain combustion as well as cool head 31 and contain the flame within it. From FIG. 2, it will be seen that the gas igniting electrode 29 enters into the first expansion chamber 53 through one of the air apertures 59. The latter may suitably be of circular shape.

Figure 3:
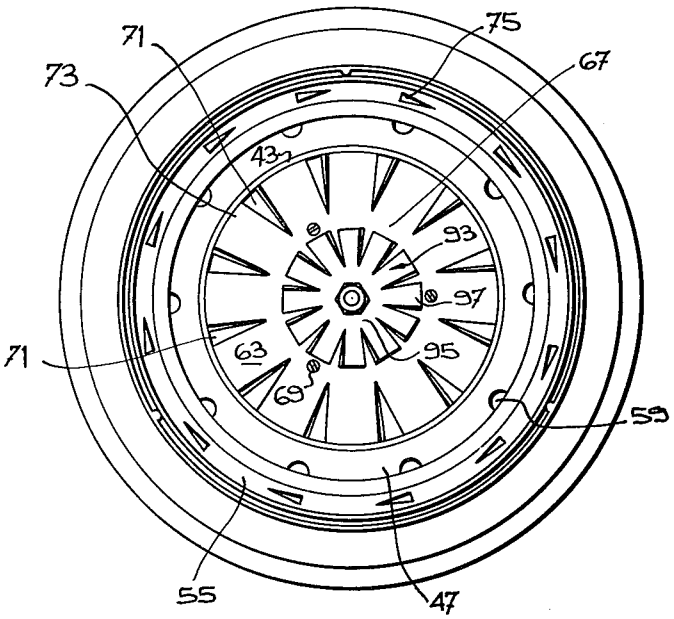
FIG. 3 is an end view of the burner assembly of FIG. 2, the catalytic screen being removed.
Figure 6:
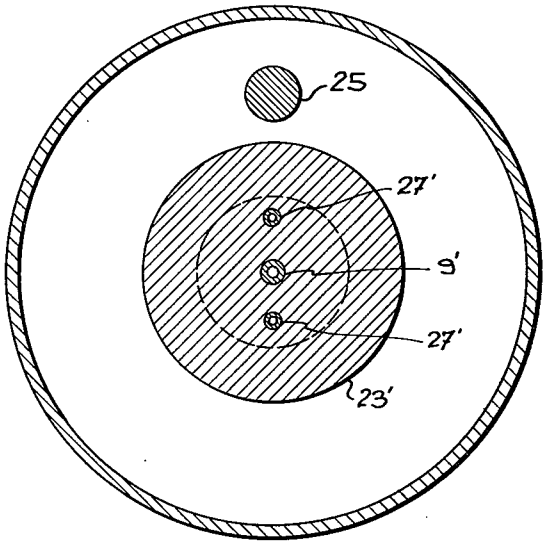
FIG. 6 is a vertical section through line VI—VI of FIG. 5.

As possibly best seen in FIG. 3, the head 31 has a primary air inlet annular plate 63 at the inlet end of the first cylindrical section 43. This plate 63 has a central opening 65 (see FIG. 2) surrounding the mouth 41 of the nozzle 37 and a continuous annulus 67 securing the annular plate 63, and thus the flame retention head 31, to the nozzle 37 by means of screws 69 threading into tapped bores in the face 39 of the nozzle 37. The peripheral portion of the annulus 67 has a series of air inlet apertures 71 (FIG. 3) evenly distributed therearound and produced by loovers 73 which are obtained by twisting peripheral portions of the annulus 67 out of its plane, about a radial axis located in the plane, as is known. The annular plate 63 is also fixed to the first cylindrical section 43 of the head 31 through the loovers 73. While the mixing chamber 45 is shown as slightly conical, for accommodating the loovers 73, it may be considered as essentially cylindrical.

Because of the particular shape of the loovers 73 and the ensuing shape of the apertures 71, it will be understood that the primary air moving into the mixing chamber 45 is greatly perturbed thereby promoting an efficient mixture with the gas discharged from the nozzle 37.

The outwardly convex section 55 likewise has a series of air inlet apertures 75 which, like apertures 71 may be triangular in shape and are evenly distributed around the said convex section 55. Behind this section 55, there is provided an annular cap 77 which has an outwardly convex or parabolic shape corresponding to that of the convex section 55 and which slidably fits over it. This cap 77 is provided with air apertures therethrough which correspond in number, size and location therearound to apertures 75 of the convex section 55 so that the apertures of the cap and those of the convex section 55 may be brought into partial or full registry. Furthermore, these cap apertures are defined by loovers 79 which are punched out of the cap 77 in a manner similar to the loovers 73 of the primary air annular plate 63. The convex section 55 has a circumferential elongated slot 81 (FIG. 2) through which a screw 83 fits which screws into a receiving threaded bore of the cap 77. Thus, the screw 83 may be slightly loosened to allow limited rotation of the cap 77 and then tightened after a suitable size of air apertures 75 is obtained. In this manner, partial or full registry may be had of the air apertures of convex section 55 and cap 77.

It has been mentioned previously that the head 31 is secured to the nozzle 37 through the primary air annular plate 63 and that, in turn, the nozzle assembly 23, through the gas line 9, is slidably mounted in an adjustable manner on the radial wall 7 of the air pipe 1. Now, the other end of this total assembly (gas line 9, nozzle 37 and head 31) is likewise supported and guided at the other end by the previously mentioned mounting support 33. The latter is a solid body having a first cylindrical part 85 of which the inner diameter is suitable for the said part to sealingly fit over the air pipe 1. Means, not shown, secure this first part to the pipe 1. The support 33 also has a second cylindrical part 87 which has an inner diameter smaller than the inner diameter of the first part and the two cylindrical parts 85, 87 are joined by a conical middle part 89.

As clearly shown in FIGS. 2 and 2*a*, the second cylindrical part 87 of the support 33 has, along its inner face, elongated ribs 91 that extend longitudinally and radially inwardly, being evenly spaced circumferentially around part 87. These ribs, as will be gathered, are meant to support and guide that particular end of the head 31 when the head, the nozzle and the gas supply line are bodily displaced axially of the air pipe 1 by the means aforesaid provided for this purpose on the radial wall 7 of the air supply pipe 1 (FIG. 1). Three such ribs 91 will usually be found sufficient. At the same time, the convex section 55 and its overlapping cap 77 are provided, at their peripheries, with shallow grooves serving as seats for the tips of the ribs 91. In this manner, it will be understood that the peripheries of the convex section 55 and the cap 77 stand at a distance from the inner face of the second part 87 thereby leaving outlet passages for air, between the ribs.

Again referring to FIGS. 2 and 3, the burner assembly has a spinner plate 93 mounted downstream of the discharge mouth 41 of the nozzle 37 and transversely of the first cylindrical section 43 of the head 31. It is made up of a central flat body 95 and an outer annulus, peripherally of the central body 95. Loovers 97 are formed in the said annulus in the same manner as the loovers 73 of the primary air annular plate 63. This spinner plate 93 is of course intended to cause a great turbulence in the gas outcoming from the burner mouth 41 to efficiently mingle with the turbulent primary air coming through plate 63 across the inlet apertures 71 thereof.

The spinner plate 93 is, as shown, secured at the end of the aforesaid adjustment rod 21, the latter having a portion thereof threading through a tapped bore of bearing 99 which is the central portion of a transverse strut 101 of which the ends are secured to the nozzle body 23. The other end of the adjustment rod 21 is diametrically slotted as at 103, lying outwardly of the air supply pipe 1, as shown in FIG. 1. It will readily be understood that rotation of the adjustment rod 21, by a screwdriver for instance, will adjust the position of the spinner plate 93 with respect to the discharge mouth 41 of the nozzle 37. Outward movement of the spinner plate 93, away from discharge mouth 41, may be stopped by means of a nut 103 on the rod 21 while inward movement with respect to the mouth 41 may be limited by triangular tips 105 on the face of the annulus 67 of the primary air annular plate 63.

With the above description in mind, it will be understood that pressure air supplied by the blower 5 and entering into the plenum chamber 3 may be said to divide itself, from thereon, into four different air streams. The main airstream, located centrally and around the nozzle 37, enters through the primary air apertures 71 into the mixing chamber 45 while being violently swirled. In the chamber 45, it brutally meets the likewise strongly swirling gas coming out of the space between the spinner plate 93 and the annular radial wall 39 of the nozzle 37 so that a very efficient first mixing of the gas and air takes place.

Immediately thereafter, the then ignited fuel and air mixture is subjected to a sudden expansion in the chamber 53, the control of the flame, sustainment of combustion and first cooling of the head 31 takes place by means of the secondary air coming through the air apertures 59 of the conical section 47. This expansion in the chamber 53 is immediately followed by a contraction of the mixture flow in the throttle chamber 54 to be immediately expanded again in the second expansion chamber 57 formed by the outwardly convex or parabolic section 55. In that area, a third swirling stream of air exits through the apertures 75 again to sustain combustion, control the pattern of the flame and cool the relevant section of the head 31. By suitably displacing the head 31 along the ribs 91 of the mounting support 33, it is possible thereafter to retain the desired flame pattern further. This is assisted by the fourth stream of air which flows along the inner periphery of the second part 87 of the support 33. It should further be noted that the conical part 89 of this same support 33 increases the air pressure and speed in that area further enhancing the flame retention and control as well as cooling of the support itself.

Figure 5:
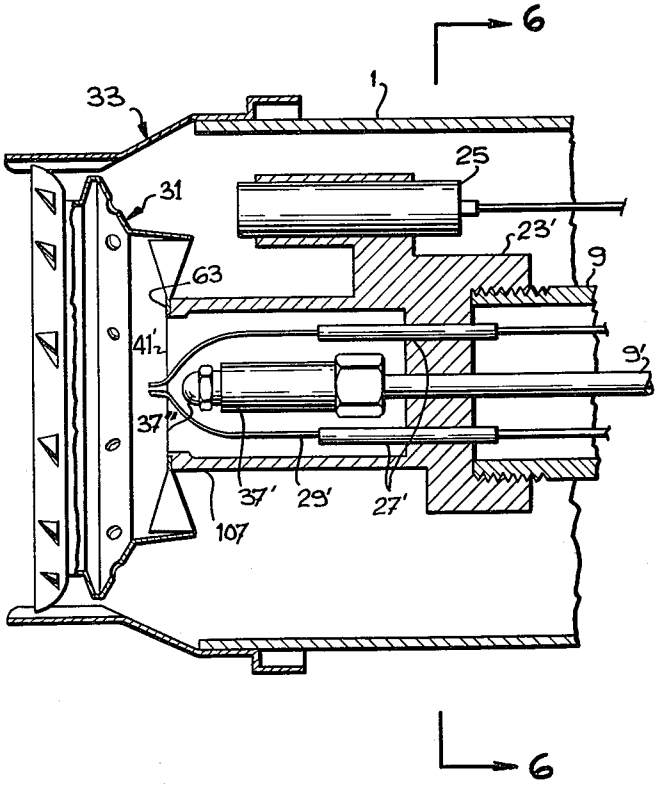
FIG. 5 is a longitudinal cross-sectional view similar to that of FIG. 2 but showing the invention used in an oil-burning installation.

The burner assembly of FIG. 5, for use with oil, has a four-stage flame retention head 31 which is identical to the embodiment of FIG. 2 and this applies also to its mounting on the support 33 secured to the air supply pipe 1.

In this case, an oil nozzle 37' has a nozzle tip 37'' standing short of a discharge mouth 41' being the end of a cylindrical outlet 107 made in the nozzle body 23' and at the center of which the oil burner 37' is mounted, an oil pipe 9' feeding the nozzle. Two electrodes 29' of two electric oil ignitors 27' are bent forwardly of the burner tip 37'' to ignite the oil mist as it is ejected therefrom.

The primary annular plate 63 of the head 31 is secured on the outer face of the cylindrical outlet 107. As is the case with the gas burner of FIG. 2, the oil line 9' may serve as an adjustment rod to locate the burner tip 37'' in relation to the discharge mouth 41'.

This type of burner does not necessitate any spinner plate or catalytic screen.

Figure 8:
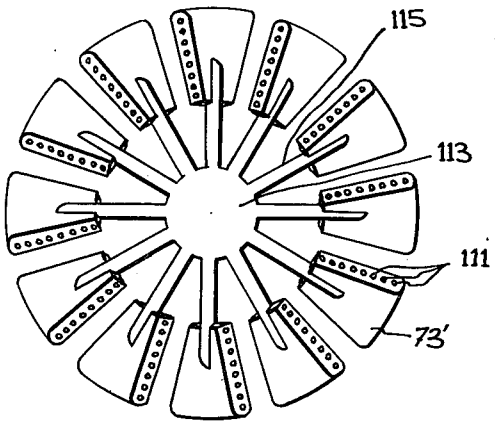
FIG. 8 is a front view of the burner improvement of FIG. 7.
Figure 7:
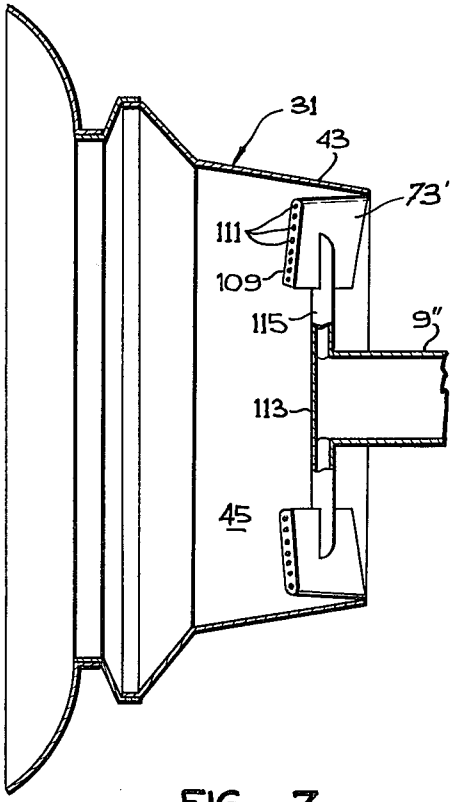
FIG. 7 is a variant of the invention for use in a gas-firing burner installation.

In the embodiment illustrated in FIGS. 7 and 8, being a gas fired installation, the flame retention and pattern control head 31 is of exactly the same shape as that of the embodiments of the previous figures except that, as shown, it may be made of separate parts joined together as by welding. This particular embodiment is of interest in the association therewith of an improved type of gas burner and slightly modified head 31.

As shown, the loovers 73' within the primary air inlet annular plate 43, of the head 31, are generally flat hollow members having a leading edge 109 projecting into the mixing chamber 45 and provided with gas apertures 111 through the said leading edge 109. A gas supply line 9'' has a closed end 113 and a series of tubular feeders 115 radially projecting from the gas line 9'', each feeder having the outer free end connected to one of the tubular loovers 73' in such a manner as to open into it whereby to feed gas therein that is then discharged through the leading edge apertures 111.

Finally, and as shown, the flame retention head 31 may be made of separate parts interconnected, as shown, and secured together in any known manner.

I claim:

1. A four-stage flame retention head assembly for use in the air pipe of a fuel burner having a fuel nozzle mounted coaxially within the air pipe, said head assembly comprising:

(a) an outwardly diverging retention head adapted to be mounted within the air pipe, concentrically thereof, and to the front of the fuel nozzle, the said retention head comprising, successively: a substantially cylindrical first section defining an air-and-fuel mixture chamber; an outwardly flaring frusto-conical section followed by a second cylindrical section, further followed by an inwardly flaring frusto-conical section, said flaring frusto-conical sections and said second cylindrical section defining therebetween a first expansion chamber; a third cylindrical section following said inwardly flaring frusto-conical section and defining a throttle chamber, and an outwardly convex section defining a second expansion chamber;

(b) a primary air inlet annular plate mounted transversely at said inlet end of said first cylindrical section, said transverse plate having a central opening circumscribed by a continuous annulus provided with a series of air inlet apertures and with loovers extending over said apertures outwardly of said annulus whereby to cause air to swirl as it enters said mixture chamber and mix therein with the fuel discharged from said nozzle, and (c) wherein said outwardly flaring conical section and said outwardly convex section have circumferentially spaced air apertures therethrough to pass air into said retention head to sustain combustion therein and to cool said head.

2. A head assembly as claimed in claim 1, wherein said convex section is parabolic in cross-section.

3. A head assembly as claimed in claim l, further comprising: an annular cap having an outwardly convex shape corresponding to that of said outwardly convex section and slidably fitting thereover, said cap being provided with air apertures therethrough corresponding in number, size and location therearound to those of said outwardly convex section, whereby said apertures of said cap and convex section may be brought into partial or full registry, and means locking said cap and convex section into selected partial or full registry, said cap further having loovers extending over the apertures thereof and projecting away from the convex surface of said cap.

4. A head assembly as claimed in claim 3, wherein said cap and said convex section are parabolic in cross-section.

5. A head assembly as claimed in claim 3, including a support, outwardly of said head, for mounting said head on said air pipe, said mounting support comprising: a first cylindrical part having an inner diameter suitable for said part to fit and be fixed sealingly over the end of said air pipe; a second cylindrical part having an inner diameter smaller than the inner diameter of said first part and a conical middle part joining said first and said second cylindrical part; elongated ribs extending longitudinally and radially inwardly of said second cylindrical part, being circumferentially spaced therearound; and wherein said outwardly convex section of said head has means thereon allowing said head to be slid along said ribs in spaced relation of said outwardly convex section with said second cylindrical part of said support whereby to allow air to pass therebetween.

6. A head assembly as claimed in claim 3, further comprising: a conical catalytic screen fixed to the outer end of said outwardly flaring convex section.

7. A fuel burner assembly comprising:

(a) an air pipe having an outlet end and an inlet end;

(b) a fuel burner having a fuel nozzle and means mounting said burner in said pipe with said nozzle located at said pipe outlet end;

(c) an outwardly diverging retention head mounted within the air pipe concentrically thereof and in front of said fuel nozzle, the said retention head comprising, successively from said fuel nozzle, a substantially cylindrical first section defining an air-and-fuel mixture chamber; an outwardly flaring frusto-conical section followed by a second cylindrical section, further followed by an inwardly flaring frusto-conical section, said flaring frusto-conical sections and said cylindrical section defining therebetween a first expansion chamber; a third cylindrical section following said inwardly flaring frusto-conical section and defining a throttle chamber, and an outwardly convex section defining a second expansion chamber;

(d) a primary air inlet annular plate mounted transversely at said inlet end of said first cylindrical section, said transverse plate having a central opening circumscribed by a continuous annulus provided with a series of air inlet apertures and with loovers extending over said apertures outwardly of said annulus whereby to cause air to swirl as it enters said mixture chamber and to mix therein with fuel discharged from said nozzle, and means fixedly mounting said transverse plate annulus on said nozzle around the discharge mouth of said nozzle;

(e) wherein said outwardly flaring conical section and said outwardly convex section have circumferentially spaced air apertures therethrough to pass air into said retention head to sustain combustion therein and to cool said head;

(f) an annular cap having an outwardly convex shape corresponding to that of said outwardly convex section and slidably fitting thereover; said cap being provided with air apertures therethrough corresponding in number, size and location therearound to those of said outwardly convex section whereby said apertures of said cap and of said convex section may be brought into partial or full registry, and means locking said cap and convex section into selected partial or full registry, said cap further having loovers extending over the apertures thereof and projecting away from the convex surface of said cap;

(g) a support, outwardly of said head, mounting said head on said air pipe, said mounting support comprising: a first cylindrical part having an inner diameter suitable for said first part to sealingly fit over and fix to said end of said air pipe; a second cylindrical part having an inner diameter smaller than the inner diameter of said first part and a conical middle part joining said first and said second cylindrical parts; elongated ribs extending longitudinally and radially inwardly of said second cylindrical part, being circumferentially spaced therearound; and wherein said outwardly convex section of said head has means thereon allowing said head to be slid along said ribs in spaced relation of said outwardly convex section with said second cylindrical part of said support whereby to allow air to pass therebetween, and (h) means slidably mounting said burner on said air pipe inlet end for displacing said nozzle and said frame retention head together longitudinally of said air pipe.

8. A fuel burner assembly as claimed in claim 7, wherein said loovers of said primary air inlet annular plate are generally flat hollow members having a leading edge projecting into said first cylindrical section and provided with apertures through said leading edge; and further comprising: a gas supply line having a closed end; tubular feeders radially projecting from said gas line at said closed end, each of said feeders having the outer end thereof connected to one of said loovers in such a manner as to open into it to feed gas therein that is then discharged through the said leading edge apertures.

9. A fuel burner assembly as claimed in claim 7, wherein said burner is a gas burner and said means slidably mounting said burner on said air pipe inlet end comprises: a gas supply line for said burner said burner assembly further comprising: a spinner plate mounted transversely inwardly of the free end of said cylindrical first section of said flame retention head, downstream of the discharge mouth of said gas supply line, said spinner plate having a central flat body, an outer annulus around and integral with said flat body, and loovers on said outer annulus extending outwardly from said annulus to define apertures intended to promote mixing and swirling of said gas and air; and means to displace said spinner plate bodily with respect to the discharge mouth of said nozzle to vary gas feed into said mixing chamber.

10. A fuel burner assembly as claimed in claim 9, wherein said spinner plate displacing means comprises a rod fixed at one end thereto and extending longitudinally within said gas supply line, the other end of said rod extending through the inlet end of said air pipe, and means controllable from outside of said air pipe to longitudinally move said rod and said spinner plate.

11. A fuel burner assembly as claimed in claims 9 or 10, further comprising a conical catalytic screen fixed to the outer end of said outwardly flaring convex section.

12. A fuel burner assembly as claimed in claims 9 or 10, including gas ignition means on said first frusto-conical section.

13. A four-stage flame retention head assembly for use in the air pipe of a fuel burner having a fuel nozzle mounted coaxially within the air pipe, said assembly comprising:

(a) an outwardly diverging retention head adapted to be mounted within the air pipe concentrically thereof and to the front of the fuel nozzle, the said retention head comprising, successively from the front of the nozzle: a substantially cylindrical inner section defining an air and fuel mixture chamber, an outwardly flaring frusto-conical section followed by a second cylindrical section, further followed by an inwardly flaring frusto-conical section and, at the end of said inwardly frusto-conical section a further cylindrical section defining, successively, an inwardly open expansion chamber and a throttle chamber, and an outwardly flaring convex section defining a second expansion chamber;

(b) a primary air inlet annular plate mounted transversely at the inlet end of said first cylindrical section, said transverse plate having a central opening circumscribed by a continuous annulus provided with a series of air inlet apertures and with louvers extending over said apertures outwardly of said annulus whereby to cause air to swirl as it enters said mixture chamber and mix therein with the fuel discharged from said nozzle, and (c) wherein said wall means and said outwardly convex section have circumferentially spaced air apertures therethrough to pass air into said retention head to sustain combustion therein and to cool said head.

* * * * *